United States Patent [19]

Pereira

[11] Patent Number: 4,879,940

[45] Date of Patent: Nov. 14, 1989

[54] PICK FOR STRINGED MUSICAL INSTRUMENTS

[76] Inventor: Mark L. Pereira, 1212 Kirkham St., San Francisco, Calif. 94122

[21] Appl. No.: 252,896

[22] Filed: Oct. 3, 1988

[51] Int. Cl.[4] ..... G10D 3/16

[52] U.S. Cl. ..... 84/322; D17/20

[58] Field of Search ..... 84/322; D17/20

[56] References Cited

U.S. PATENT DOCUMENTS

| | | | |
|---|---|---|---|
| 401,476 | 4/1889 | Barnes | 84/322 |
| 413,579 | 6/1889 | Stewart | 84/322 |
| 566,806 | 9/1896 | Shearer | 84/322 |
| 1,296,284 | 5/1919 | Gilman | 84/322 |
| 1,444,982 | 2/1923 | Orth | 84/322 |
| 2,016,438 | 10/1935 | Kealoha | 84/322 |
| 2,045,571 | 6/1936 | Dopyera | 84/322 |
| 3,650,172 | 3/1972 | Osborne | 84/322 |
| 3,739,681 | 6/1973 | Dunlop | 84/322 |
| 4,741,239 | 5/1988 | Crafton | 84/322 |

*Primary Examiner*—Lawrence R. Franklin

[57] ABSTRACT

A pick for stringed musical instruments comprising a pick head 10, pick face 11, upper striking surface 12, pick ears 13, pick neck 14, pick body 16, pick arms 18, pick tail 20, and click muffling and pick arm restraining material 22. Said pick is worn around the distal phalange of the fingers or thumb such that said pick head is worn over the nail. Said pick head can be bent and shaped to have a desired curvature or to follow the curvature of said nail. Said pick tail acts as a counterpressure to the upward pressure which occurs on said pick head during the musical function called an upstroke, thus preventing said pick head from lifting excessively away from said nail. The portion of said pick head that extends beyond the fingertip can be adjusted, even during the playing operation, by sliding said pick further in or out along said distal phalange. Said click muffling and pick arm restraining material is capable of being used to muffle sounds produced between plural picks and to restrain said pick arms from substantially spreading apart, thus preventing said pick head from lifting excessively away from said nail. Said pick can be used in the same manner as a human nail, plectrum or a sitar-type pick. Said pick can be used on a variety of types of strings such as steel, nylon, gut or wound strings.

14 Claims, 3 Drawing Sheets

PICK FOR STRINGED MUSICAL INSTRUMENTS

BACKGROUND--FIELD OF INVENTION

This invention relates to a device for plucking the strings of a musical instrument.

BACKGROUND--DESCRIPTION OF PRIOR ART

Plucking the strings of a musical instrument may be achieved in a number of ways: (1) use of a hand held plectrum, (2) sitar-type pick, (3) fingers and/or thumb without fingernails and thumbnail [hereafter "nails"], (4) fingers and/or thumb with nails (5) fingers and /or thumb with nails reinforced with nail hardeners or glue-on nail extensions, (6) fingers and/or thumb picks worn around the distal phalanges such that the string actuating means of the pick is worn under the distal pads, (7) use of finger and/or thumb picks worn around the distal phalanges such that the string actuating means of the pick is worn over the nail.

The plectrum is a flat, often triangular, piece of plastic or some other resilient material which is usually held by pinching said plectrum between the thumb and index finger. The use of said plectrum has disadvantages in that while holding said plectrum, the index finger cannot be used to pluck any strings. Said plectrum is difficult to hold, requiring constant manipulation of said plectrum to maintain its proper playing position. Said plectrum can easily be dropped while playing a musical instrument. Use of said plectrum limits the styles of music which can be played by the users.

Sitar-type picks are characterized by a thin wire bent such that it forms a band that encircles and grasps the distal phalange. Said wire forms a loop that extends from said band such that it goes over the nail, under the fingertip and finger pad and attaches to the bottom portion of the band. Said picks are usually worn on the index and middle fingers and are used in a manner some what similar to that of a plectrum, but said pick is not pinched with the thumb. The disadvantage with said pick is that is produces raspy, scratchy noises when plucking wound strings.

The use of fingers and/or thumb without nails to pluck strings has disadvantages in that the sound produced in this manner is often low in volume, muffled in tone and limited in the variety of timbres which can be produced. In addition, the fingers and thumb are easily made sore when plucking the strings in this manner, often resulting in blisters or callouses. Calloused fingers may produce raspy and harsh tones when plucking the strings. In addition, it is extremely difficult for even an accomplished musician to achieve a plucking speed with his fingers which is comparable to that which can be achieved by even a novice musician using a hand held plectrum. This is true for other means of plucking the strings mentioned below in which the string actuating method does not allow the users to pick the strings in a manner similar to that as with a hand held plecturm or sitar-type pick.

The use of fingers and/or thumb with nails is characterized by nails that extend beyond the fingertip and in combination with said fingertip form the string actuating means for plucking the strings. The use of fingers and/or thumb with nails has disadvantages in that nails are easily chipped, broken, scratched, worn down, and are thus difficult to maintain in a proper playing condition. Children and adults often have a great deal of difficulty in growing and maintaining nails due to varied physical activities, jobs, genetic predispositions and the result of nuritional habits. In addition, nails take a long time to grow to a length suitable for plucking the strings of a musical instrument. Nails grow at about one millimeter per week. It is very difficult to determine the proper nail shape and length most suitable for an individual user because once the nails are filed to a certain shape and length, the nails cannot be reshaped without making them shorter. Nails come in a variety of shapes, some of which can be difficult to use effectively in plucking the strings. In addition, there is a natural inhibition in striking the strings too hard because the nails may be damaged, therefore, the loudness the users may strike the strings is directly related to the strength of their nails. The use of nails prevents the users from using no nails.

Nail hardeners or nail extensions are placed on the exposed surface of the natural nail. Nail hardeners are painted on to the nail surface. Nail extensions are glued to the nail surface. Use of nail hardeners and/or glue-on nail extensions to strengthen and/or extend the length of the natural nail has disadvantages in that they may cause medical problems with the natural nail, fingertip or cuticle. Because of their medical ramifications, these products may be used for only a limited period of time. In addition, these products can be difficult and messy to use. It takes a considerable amount of time to apply and take off these products as compared to slipping one and off a finger pick. These products may produce an aesthetically displeasing tone as well as be visually displeasing. The use of nail hardeners or nail extensions prevents the users from using no nails.

Picks worn around the distal phalanges of the fingers such that the string actuating means of the pick is worn under the distal pads are characterized as having a ring-like band or arms that encircles and grapss the finger. Said pick has a projection from the central portion of the ring-like band which is somewhat triangular in shape and which follows the general contour of the fingertip. Picks worn around the distal phalange of the thumb are characterized as having a ring-like band or arms that encircles and grasps the thumb. Said pick has a somewhat triangular projection which extends from under the distal pad perpendicular to the thumb. Said finger and thumb picks have disadvantages in that they produce a loud noise when plucking the strings. Said noise is particularly noticeable when plucking nylon strings. In addition, said picks do not allow the skin of the user to touch the strings, thus preventing the user from feeling the strings and thereby giving said user of disoriented string actuating method. If plural picks are worn, unwanted sounds may be produced when said picks touch each other. Said picks are easily dislodged from their optimal playing position. In addition, said finger picks cannot be used for downstrokes because they will snag on the strings due to their inferior design. In addition, said thumb pick cannot be used on upstrokes, unless it is pinched between the thum and index finger, because it will get dislodged from its proper playing position due to its inferior design.

Picks worn round the distal phalanges of the fingers or thumb such that the string actuating means of the pick is worn over the nail are characterized as having a nail-like portion worn over the nail and some means of securing said pick to said distal phalange. Prior art patent designs of said picks are inferior to my design in that the string actuating means of said picks is not adjustable to the many and varied sizes and shapes of the nails they are designed to replace. In addition, the length of the string actuating means of said picks which extends beyond the fingertip cannot be easily adjusted by the users while playing a musical instrument.

Most accomplished musicians and novices alike would find it desirable to have an invention, such as mine, which would eliminate the use of nails and other inferior string actuating means and which would facilitate plucking the strings. My invention provides the users with a device which will allow them to play more accurately, in more styles and produce sounds not previously possible with any one of the previously described nails, picks or plectrums. In addition, the users of my invention may also be able to play faster and louder than previously possible with nails.

OBJECTS AND ADVANTAGES

Accordingly, several objects and advantages of my invention are that the pick is worn around the distal phalanges of the fingers or thumb such that the string actuating means of the pick is worn over the nail. Said string actuating means can be bent relative to the pick body and shaped by the users to have a desired curvature or follow the contours of their own nail. The users will be able to play for longer periods of time because the material said pick is made from is stronger than nails and will therefore wear down slower than nails. Said pick is held on the distal phalange by pick arms which can be bent so as to comfortably fit the user's fingers or thumb. Said pick arms are capable of being covered in such a manner as to eliminate any unwanted sounds produced by contact between plural picks. Adjustments to the length of the string actuating means of the pick that extends beyond the fingertip can be made with the hand the picks are on, even while playing a musical instrument, by sliding the pick further in or out from the fingertip by using the thumb and/or one of the other fingers. Said picks can be easily slid on and off the fingers and thumb, allowing the users to play music that requires the use of no nails and music that requires nails in essentially a traditional manner. The users may experiment with the length and shape of the string actuating means of the pick to determine what works best for them. Said picks may be made of various materials, which will add greatly to the variety of timbres available to the user. Said picks may be used on various types of strings such as nylon, gut, steel and wound strings. Said picks will allow the users to pluck the strings in a natural manner, as if they were using their own nails. The users of said picks will be able to play more accurately because the picks can be adjusted to the exact length and shape most suitable for said users. Said picks will provide a natural tone. Said picks will provide all the timbres previously associated only with natural nails. Said picks will be able to provide sounds not available with nails, other type picks and plectrums. The users of said picks will also be able to strike the strings more forcefully than with natural or hardened nails because there will be no fear of damaging or tearing their nails off, and therefor they may be able to produce louder tones. My pick invention may improve the biomechanics of plucking the strings of musical instruments by decreasing or eliminating the need of the distal joint to collapse when plucking said strings. Said pick worn on the index finger may also be used like a plectrum or sitar-type pick, providing a means to achieve picking speeds not generally attainable with the fingers along.

DRAWING REFERENCE NUMERALS

Figure 1:
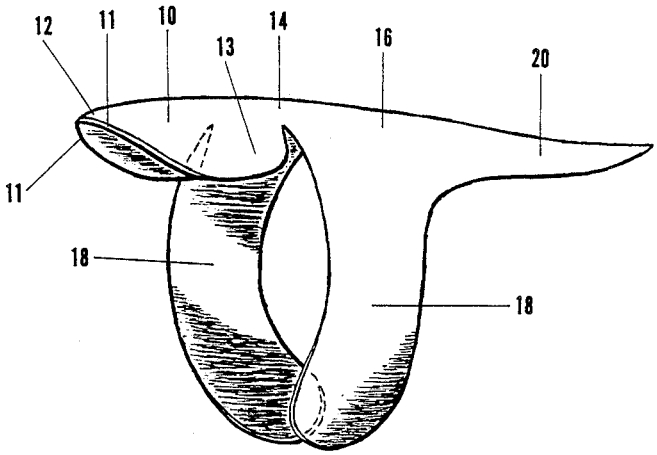
FIG. 1 shows a perspective side view of the pick.

10: pick head
11: pick face
12: upper striking surface
13: pick ear/or ears
14: pick neck
16: pick body
18: pick arm/or arms
20: pick tail
22: click muffling and pick arm restraining material

DESCRIPTION OF INVENTION - THE PREFERRED EMBODIMENT

Referring now to FIGS. 1–7, my pick invention is comprised of the pick head 10, pick face 11, upper striking surface 12, pick ears 13, pick neck 14, pick body 16, pick arms 18, pick, tail 20, and click muffling and pick arm restraining material 22.

Said pick may be made of any suitable material, such as plastic or metal, that offers sufficient rigidity for plucking the strings but at the same time can be bent and shaped to conform to the user's nail, finger and/or thumb and yet retain its shape. Said pick may be made in one piece or plural pieces without departing from its spirit, essence or scope.

Pick Head, Pick Face and Upper Striking Surface: Referring now to FIGS. 1–7, the pick head 10 is shaped somewhat similar to a human nail and forms the string actuating means of said pick.

The pick face 11 forms the leading edge of said pick head and comes in contact with the strings during the musical function called an upstroke. The upper striking surface 12 is the outer surface of the pick head 10 that comes in contact with the strings during the musical function called a downstroke. Said pick face and said upper striking surface should be smooth such that they will slide over the strings without snagging on them.

Figure 3:
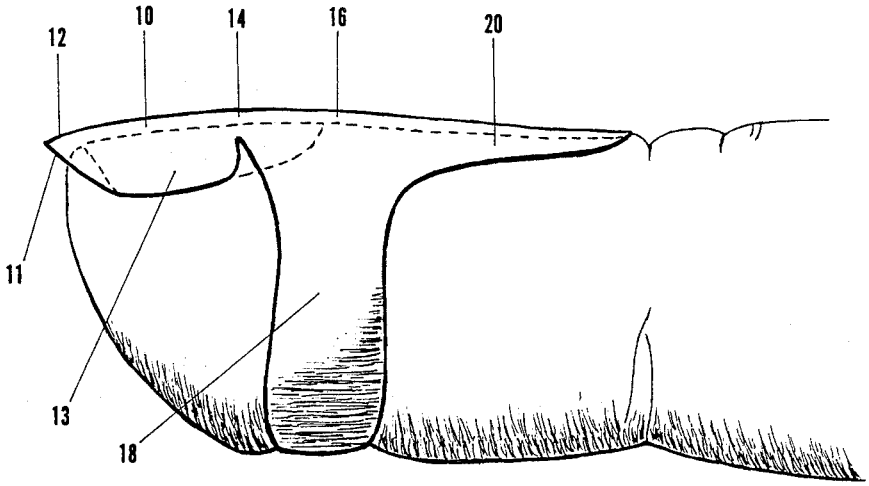
FIG. 3 shows a side view of the pick as worn on a finger.
Figure 4:
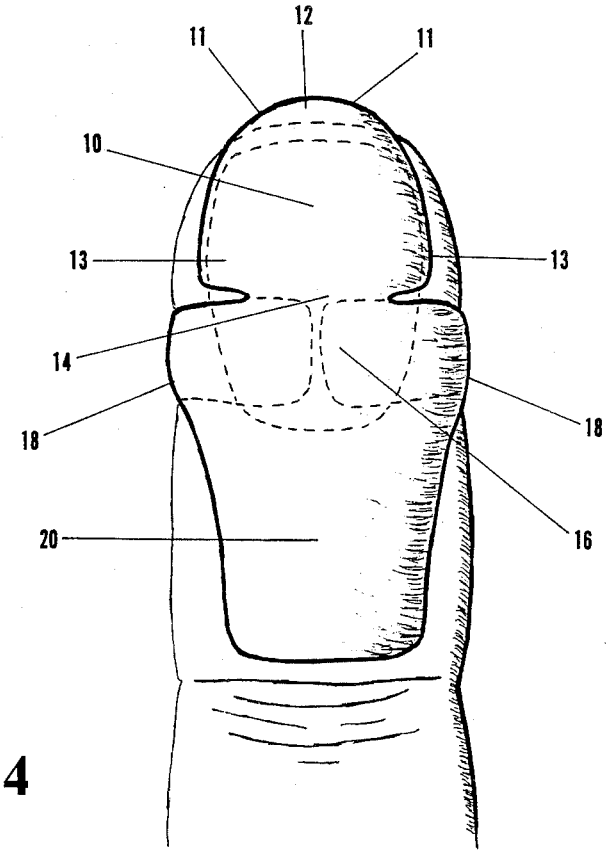
FIG. 4 shows a top view of the pick as worn on a finger with phantom lines indicating the fingertip, nail and the pick arms.
Figure 5:
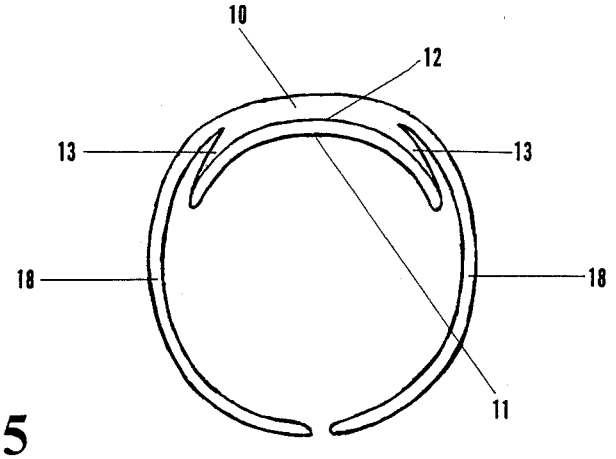
FIG. 5 shows a front view of the pick with the pick ears in a low position.
Figure 6:
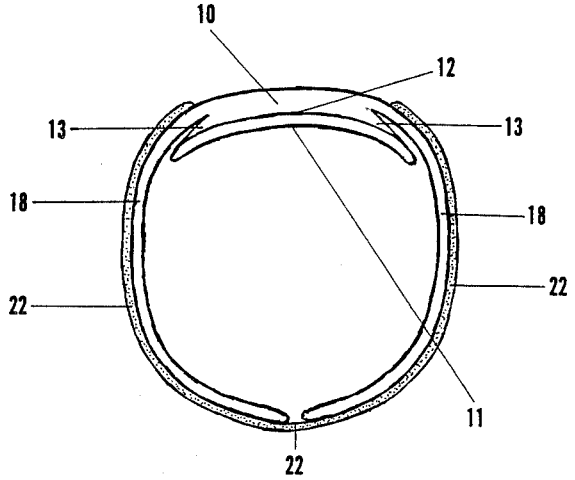
FIG. 6 shows a front view of the pick with the pick ears in a middle position and the click muffling and pick arm restraining material covering the pick arms.
Figure 7:
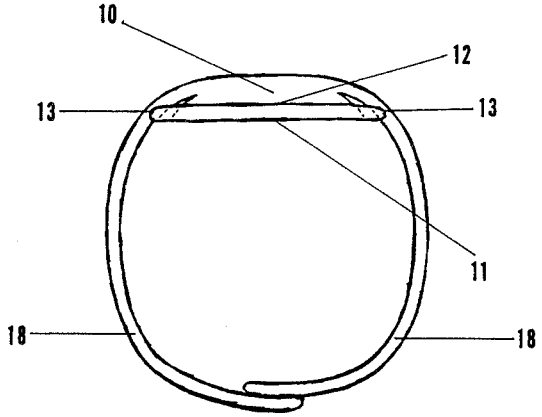
FIG. 7 shows a front view of the pick with the pick ears in a high position and the pick arms overlapping each other.

Pick Ears and Pick Neck: Referring now to FIGS. 1–7, the pick ears 13 form the posterior side elements of the pick head 10. The string actuating means is wider than the interface means connecting said pick head and the pick body 16. The pick neck 14 forms the interface means connecting said pick head and said pick body. Referring now to FIGS. 5–7, said pick ears, in conjunction with said pick neck, allows said pick head to be bent relative to said body and to have a desired curvature or to follow the curve of the user's nail. In addition, said pick neck allows said pick head to be bent up or down relative to said pick body so the pick face 11 my be positioned generally coplanar with the leading edge of the user's nail. Said pick neck is less wide than said pick head, as measured from the outer edges of said pick ears.

Pick Arms: Referring now to FIGS. 3 and 4, the pick arms 18 are connected to the pick body 16 and form the finger or thumb embracing means of the pick. Said pick arms are attached to said body, and are sized and oriented to be extended around the distal phalange.

Pick Tail: The pick tail 20 is connected to the central portion of the pick body 16. Referring now to FIGS. 3 and 4, said pick tail extends from said pick body at a region of said pick body located generally over the cuticle toward the distal joint.

Said pick tail is worn over the surface of the distal phalange. Said pick tail acts as the counterpressure means to the upward pressure which occurs when a string contacts the pick face 11 during an upstroke. Said pick tail lays flat against the dorsal surface of the distal phalange that extends from the cuticle to the distal joint. Said pick tail may be bent up or down, relative to said pick body, at various points along its length so as give less or more counterpressure to the pick head 10, as determined by the users. Said pick tail, as found on the thumb pick, will probably be required to be bent in a more upward position, relative to said pick body, so as to accommodate the general shape of the thumb from the cuticle to the distal joint.

Figure 2:
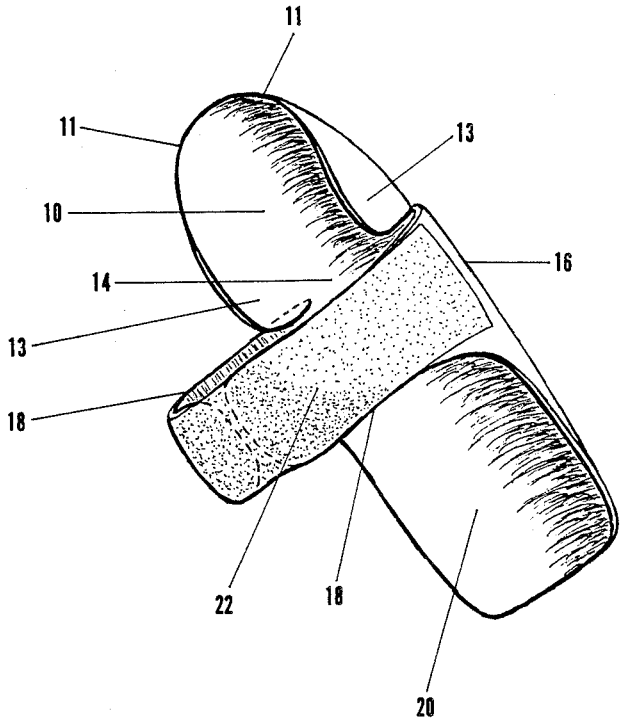
FIG. 2 shows a perspective bottom view of the pick with the click muffling and pick arm restraining material covering the pick arms.

Click Muffling And Pick Arm Restrainig Material: Referring now to FIGS. 2 and 6, the click muffling and pick arm restraining material 22 may be made of various materials, such as cotton flannel with a self-adhesive backing, that have qualities wherein said click muffling and pick arm restraining material will adhere securely to the outer surface of the pick arms 18 and pick body 16, and such tht said click muffling and pick arm restraining material will prevent said pick arms from substantially spreading apart when plucking the strings with an upstroke. In addition, said click muffling and pick arm rstraining material itself should not stretch and the outer surface of sad click muffling and pick arm rstraining material should muffle any unwanted sounds that would be produced if said click muffling and pick arm restraining material were not in place. Restraining said pick arms from substantially spreading apart when playing an upstroke is paramount in that if said pick arms spread apart substantially, the pick head 10 will lift excessively away from the fingertip giving a delayed and disoriented attack to the strings. In addition, said pick arms will spread apart and tend to pinch the distal pad if said click muffling and pick arm rstraining material is not used.

As seen in FIGS. 5–7, both inner and outer surfaces of the pick are generally cylindrical as viewed from the front, such that said pick will slip easily over the fingertip. The outer surfaces of said pick should be smooth. The edges of said pick should be rounded such that they will not cause discomfort to the users where said edges may come in contact with the skin.

The thickness of the walls of the pick should be thin, about half a millimeter to one millimeter thick, so as to minimize any clumsiness caused by thick walls.

OPERATION OF INVENTION

The users of said pick should have nails short enough that they do not contact the strings when playing an upstroke. Said pick is slipped over the finger or thumb such that the pick head 10 covers the nail and extends about one to two millimeters beyond the fingertip. Needle nose pliers with no teeth [hereafter "pliers"] should be used to bend said pick head up or down at the pick neck 14 such that the middle of said pick head fits flat against the nail and the middle of the pick face 11 is generally coplanar with the leading edge of the nail as seen in FIG. 3. Said pliers should be used to bend the pick ears 13 such that the inner surface of said pick ears lays flat against the sides of the nail and that the outer edge of the said pick ears fit comfortably into the depression beween the nail and the skin. Referring now to FIGS. 3 and 4, if said pick ears are too long to fit into said depression, they should be filed down with a nail file so they fit into said depression, using the contours of user's nail as a guideline. Said pliers should be used to make any final adjustments to the shape of said pick head so that said pick face follows the general curvature of theuser's nail.

Said pliers should be used to bend the pick arms 18 such that they fit snugly around the middle of the distal phalange. Said pick arms should not fit so tightly as to form a tourniquet.

Referring now to FIGS. 2 and 6, a strip of the click muffling and pick arm restraining material 22 should be placed from the top of the outside of one of the said pick arms, across the gap between said pick arms and up the other pick arm. Said click muffling and pick arm restraining material should extend up to the outer edges of said pick arms but not beyond the edges of said pick arms as shown in FIG. 2. Said click muffling and pick arm restraining material may be cut and used at various lengths so long as its function is not hindered. Said click muffling and pick arm restraining material need not be used if clicking sounds produced when picks touch each other does not bother the users and if the pick head 10 does not lift more than about one millimeter away from the fingertip during an upstroke.

With the pick on the finger, the users should press up under the tip of the pick head 10 with the same amount of pressure as when plucking a string with an upstroke. If said pick head lifts more than about one millimeter away fromthe fingertip the pick is too loose. Said pliers should be used to bend the pick tail 20 down to give more counterpressure to said pick head and/or bend said pick arms to fit more snugly around the finger if necessary.

It should be noted that a slight lifting of the pick head 10 away from the nail during an upstroke may be beneficial to the user in that it reduces or eliminates the necessity of the user to allow the collapse of the distal joint when plucking a string necessary to allow the nail to slide over the string without snagging on said string. It has been shown in experiments with piano players that the collapse of a joint increases the time required for key-depression fr 2/50 to 5/50 of a second. (See, *The Art Of Classical Guitar Playing* by Charles Duncan, 1980, pages 76–77.) My pick invention may actually improve the biomechanics of plucking the strings of a musical instrument by decreasing or eliminating the necessity of the distal joint to collapse during the plucking movement.

A nail file, and then very fine sand paper, 500 grit or higher, should be used to shape the pick face 11 such that said pick face follows the general contour of the user's fingertip as viewed from a position were the distal pad faces the user. Said pick face and upper striking surface 12 should be smooth, so as to produce a natrual tone and to pass over the strings without snagging on them. Experimenting with the shape of the pick head 10 and said pick face will help the users find the shape that works best for them.

Said pick can be used in the same general manner as a natural nail. Said pick worn on the index finger can also be used like a plectrum by pinching the pick arm 18 closest to the thumb with the thumb and striking the strings with upstrokes and downstrokes. Said pick may also be used like a sitar-type pick by striking the strings with upstrokes and downstrokes with the index finger without the thumb pinching said pick arm.

Said pick may be made in a plurality of sizes from small to large, various colors including transparent, and made of various materials so as to accommodate the requirements and preferences of individual users, different instruments and different types of strings.

CONCLUSION, RAMIFICATIONS AND SCOPE OF INVENTION

Thus, the reader will see that my pick invention provides a reliable, useful and economical device which can be used by persons of almost any age, on variety of stringed musical instruments, and a variety of types of strings. In addition, said pick will provide the users with a device which will allow them to play more accurately, in more styles and produce sounds not previously possible with any one of the previously described nails, picks or plectrums. My pick invention may improve the biomechanics of plucking the strings of musical instruments by decreasing or eliminating the necessity of the distal joint to collapse when plucking said strings. In addition, the users may also be able to play faster and louder than previously possible with nails.

While my above description contains many specificitions, these should not be construed as limitations on the scope of my invention, but rather as an exemplification of one preferred embodiment thereof. Those skilled in the art will be able to envision many other possible variations within its scope. For example, skilled artisans will readily be able to change the dimensions and shapes of the various embodiments. Said pick may be made in one piece or in plural pieces without departing from the spirit, essence or scope of my invention. A friction surface may be incorporated on the inner surfaces of the pick which contact the skin. Said friction surface may be of various designs but whose function is to create additional friction between the pick and the finger such that the pick will remain more firmly in place during use of said pick. Referring now to FIG. 7, the pick arms 18 may be made such that they overlap each other. Glue may be used to attach overlapping pick arms to each other to prevent said pick arms from spreading apart when plucking the strings. Said pick arms may by made such that there is only one long pick arm which extends from one side of the pick body 16 to the opposite side of said body. A flexible strap may be incorporated into the design instead of said pck arms such that it holds said pick body to the distal phalange. Instead of using a click muffling and pick arm restraining material 22, an adhesive tape or similar material may be used to fasten said pick arms together such that they won't spread apart while plucking the strings with an upstroke, thereby foregoing the click muffling function provided by said click muffling and pick arm restraining material. Openings may be provided in the pick head 10, pick neck 14, pick body 16, pick arms 18 and/or pick tail 20 to increase the resilient flexiblity of the pick and to admit air to the distal phalange of the users thus reducing the tendency of the distal phalange to perspire when playing a musical instrument. The outer edges of the said pick arms may be flared out slightly to decrease discomfort possibly caused by the edges of said pick arms biting into the skin. Said pick tail 20 may be made such that it is connected to said pick body and said pick arms. Said pick tail may be made in a variety of lengths, sizes and shapes. Said pick tail may be made so as to encircle the distal phalange. Said pick head may be made such that it forms a separate part secured to said pick body by various means. Said pick head may be made from a material which is different from the rest of the pick. Said pick arms may be made such that they form a circular band which is a separate part secured to said pick body by various means. Accordingly, the scope of the invention is determined by the appended claims and their legal equivalents, and not by the examples set forth above.

I claim:

1. A device to be worn on a human finger or thumb for use for plucking th strings of a stringed musical instrument, comprising:

(a) a string actuating means which is worn over the nail, (b) a body, (c) an interface means located at the posterior end of the string actuating means adjacent to said body and connecting the string actuating means and the body, said interface means being narrower than said string actuating means and bendable such that said interface means can be bent to position the string actuating means generally parallel with the nail, as well as conforming to the curvature of said nail, (d) a counterpresure means connected to the body, which counterpressure means extends from said body in the opposite dirction of the string actuating means and which is generally parallel with the dorsal surface of the distal phalange, and (e) a securement means which extends lateraly from the body in the region between the string actuating means and the counterpressure means.

2. The device of claim 1, wherein the string actuating means extends an adjustable distance beyond the fingertip, and wherein said distance can be adjusted by sliding said device further in or out along said distal phalange.

3. The device of claim 1, wherein said device is made of material sufficiently rigid for plucking the strings of a musical instrument, but at the same time bendable into selected shaped.

4. The device of claim 1, wherein said interface means allows said string actuating means to be bent relative to the body such that the leading edge of said string actuating means can be positioned generally coplanar with the leading edge of the nail.

5. The device of claim 1, wherein said device is made of metal.

6. The device of claim 1, wherein said counter pressure means extends from a region of the body located generally over the cuticle towards the distal joint.

7. The device of claim 6, wherein thec ounterpressure means extends to said distal joint.

8. The device of claim 7, wherein the counterpressure means extends beyond said distal joint.

9. The device of claim 1, wherein the counterpressure means lays flat against the dorsal surface of said distal phalange.

10. The device of claim 1, wherein the securement means encircles and grasps said distal phalange.

11. The device of claim 10, wherein the securement means is adjustable.

12. The device of claim 10, wherein the outer surface of the securement means is covered in such a manner so as to restrain said securement means from substantially spreading apart.

13. The device of claim 12, wherein the covered securement means muffles sounds produced when said covered securement means strikes a hard object.

14. The device of claim 1, wherein said device is made of plastic.

* * * * *